US008286560B2

(12) United States Patent
Hachet et al.

(10) Patent No.: US 8,286,560 B2
(45) Date of Patent: Oct. 16, 2012

(54) RAILWAY VEHICLE CARRIAGE FACILITATING ACCESS FOR PASSENGERS WITH REDUCED MOBILITY

(75) Inventors: Joél Hachet, La Clavette (FR); Michel Cherdo, Lagord (FR)

(73) Assignee: Alstom Transport SA, Levallois-Perret (FR)

( * ) Notice: Subject to any disclaimer, the term of this patent is extended or adjusted under 35 U.S.C. 154(b) by 194 days.

(21) Appl. No.: 12/381,189

(22) Filed: Mar. 9, 2009

(65) Prior Publication Data

US 2009/0255437 A1 Oct. 15, 2009

(30) Foreign Application Priority Data

Mar. 11, 2008 (FR) ..... 08 051551

(51) Int. Cl.
*B61D 47/00* (2006.01)

(52) U.S. Cl. ..... 105/422; 105/425; 105/329.1; 105/341; 105/344; 105/345

(58) Field of Classification Search ..... 105/329.1, 105/341, 344, 345, 355, 337, 396, 397, 422, 105/425; 104/27, 28, 29
See application file for complete search history.

(56) References Cited

U.S. PATENT DOCUMENTS

| | | | | |
|---|---|---|---|---|
| 1,130,296 | A * | 3/1915 | Jones | 105/341 |
| 1,161,903 | A * | 11/1915 | Smith | 105/341 |
| 2,281,245 | A * | 4/1942 | Parke et al. | 105/414 |
| 3,874,527 | A * | 4/1975 | Royce | 414/537 |
| 5,921,615 | A * | 7/1999 | Gimenez | 296/164 |
| 7,536,958 | B2 * | 5/2009 | Bravo et al. | 105/392.5 |

FOREIGN PATENT DOCUMENTS

| | | |
|---|---|---|
| DE | 199 14 965 | 5/2000 |
| EP | 1 787 883 | 5/2007 |
| WO | WO 99/48458 | 9/1999 |
| WO | WO 00/64721 | 11/2000 |

OTHER PUBLICATIONS

DE 29906022, Abstract page and a drawning, Aug. 10, 2000.*

* cited by examiner

*Primary Examiner* — Mark Le
(74) *Attorney, Agent, or Firm* — Davidson, Davidson & Kappel, LLC

(57) ABSTRACT

A carriage including a floor comprising at least one low platform and two high floor levels, the low platform having a floor height lower than that of the high floor levels and being arranged opposite a door, the low platform being movable in translation is provided. The low platform is connected to said high floor levels by ramps.

13 Claims, 1 Drawing Sheet

RAILWAY VEHICLE CARRIAGE FACILITATING ACCESS FOR PASSENGERS WITH REDUCED MOBILITY

This claims priority to French Patent Application FR 08 51551, filed Mar. 11, 2008, the entire disclosure of which is hereby incorporated by reference herein.

FIELD OF THE INVENTION

The present invention relates to a railway vehicle carriage of the type comprising a floor which extends above and between two bogies provided at each end of the carriage, said floor having no steps and comprising at least one low platform and two high floor levels each arranged in register with a bogie on either side of the low platform, the low platform having a floor height lower than that of the high floor levels and being arranged opposite a door of the railway vehicle carriage, the low platform being movable in vertical translation so that the height of the low platform is adjustable in order to allow the height of said platform to be adapted to the height of a railway vehicle station platform of variable height.

Some railway vehicle carriages are adapted to facilitate access for and to accommodate passengers with reduced mobility who move around by means of a wheelchair, for example.

BACKGROUND OF THE INVENTION

In such carriages the floor height of the zone that is opposite a door of the vehicle is generally lowered in order to bring it as close as possible to the height of the station platform and thus avoid the presence of high steps, which render access to the railway vehicle difficult, especially for a wheelchair. The zone of reduced floor height is connected to the other zones of the carriage, which are of standard height, by ramps, which again make it possible to avoid the use of steps, which are particularly awkward for passengers with reduced mobility.

However, the heights of different station platforms are not constant and can be higher or lower depending on the location. Accordingly, even for a carriage which has been adapted to accommodate passengers with reduced mobility, it is often necessary to use an external removable ramp which connects the low zone of the carriage to the station platform in order to allow a wheelchair to disembark. Such ramps are complicated to use because they require the intervention of the train or station staff, who must be warned in advance and who must install the ramp quickly while the train is stopped in the station, often for only a short time.

In addition, there is generally not the space necessary to provide a functional space for housing equipment of the carriage beneath the low platform, so that the carriage becomes more bulky as a result.

SUMMARY OF THE INVENTION

One of the objects of the invention is to remedy those disadvantages by proposing a railway vehicle carriage which facilitates access for passengers with reduced mobility, from several possible station platform heights, without requiring the intervention of the train or station staff, while permitting the arrangement of functional equipment in a manner similar to a conventional carriage.

The present invention provides a railway vehicle carriage of the above-mentioned type, in which the low platform is connected to said high floor levels by ramps when said low platform is in the high position.

According to other features of the railway vehicle:

- the railway vehicle carriage may comprise a functional space for housing equipment of the railway vehicle, the space being arranged substantially in register with and beneath at least part of the floor of the vehicle;
- the functional space for housing equipment may extend beneath substantially the whole of the length of the carriage;
- the railway vehicle carriage may comprise at least one intermediate platform arranged at an intermediate height between one of the high floor levels and the movable platform in the high position, the intermediate platform may be connected to the low platform in the high position and to the high floor level by way of ramps;
- a plurality of seats may be arranged on platforms so as to accommodate passengers, the platforms may have a height substantially equal to that of the high floor levels, the intermediate platform may comprise a zone which does not have seats in order to accommodate passengers with reduced mobility;
- the ramp which extends between the high floor level and the intermediate platform may have a slope of substantially from 6% to 8%;
- the ramp which extends between the high floor level and the low platform may have a slope of substantially from 5% to 7%;
- the ramp which extends between the intermediate platform and the low platform may have a slope of substantially from 6% to 8%;
- the floor height of the low platform may be variable substantially from 550 mm to 950 mm relative to the rails on which the railway vehicle is to travel;
- the floor height of the intermediate platform may be substantially from 1000 mm to 1200 mm relative to the rails on which the railway vehicle is to travel;
- the height of the high floor levels may be substantially from 1200 mm to 1300 mm;
- the difference in height between the floor and the ground clearance of the railway vehicle may be substantially from 400 mm to 700 mm; and
- the railway vehicle carriage may comprise means for the remote control of the translation of the low platform such as can be used by a passenger of the railway vehicle.

BRIEF DESCRIPTION OF THE DRAWINGS

Other aspects and advantages of the invention will become apparent from reading the following description, which is given by way of example and with reference to the accompanying drawings, in which.

DETAILED DESCRIPTION

In the figures, a carriage of the so-called articulated rake type has been shown. That is to say, the bogies shown at the ends are common to two adjacent carriages. It will be understood, however, that the invention is also applicable to carriages each having their own two bogies.

In the description, the term height is defined relative to the rails on which a railway vehicle is to travel and in a substantially vertical direction when the vehicle is positioned on the rails.

Figure 1:
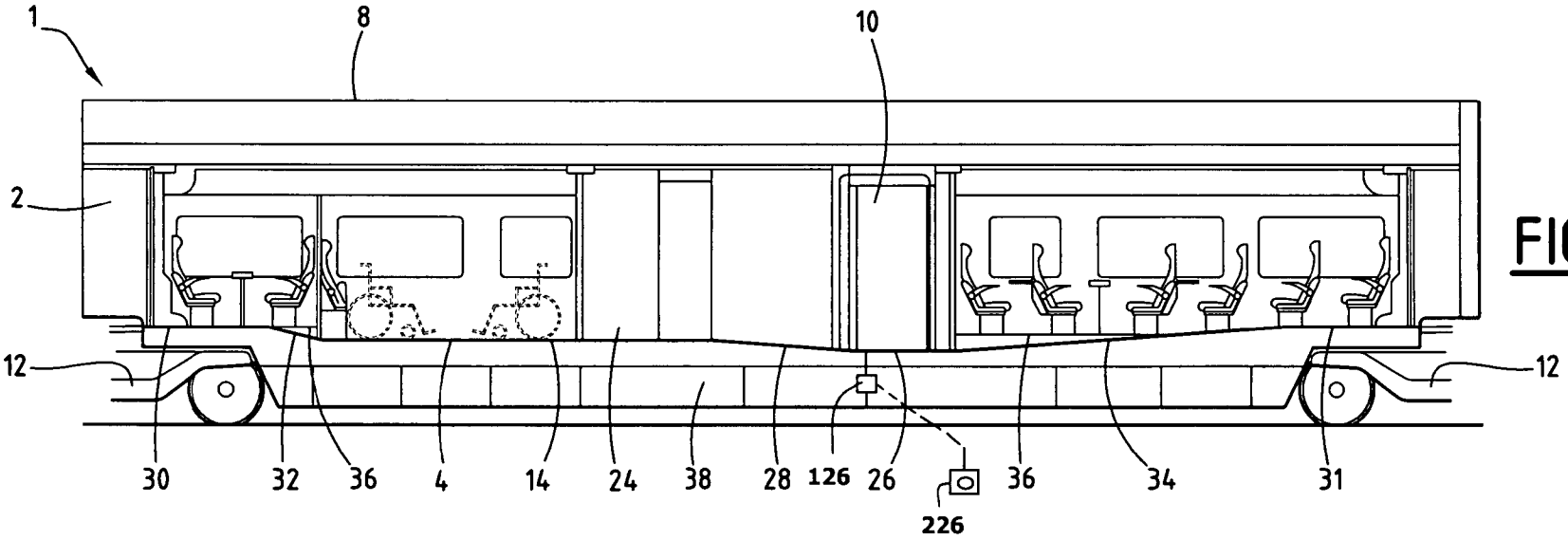
FIG. 1 is a cutaway view, in diagrammatic form, of a railway vehicle according to the invention.
Figure 2:
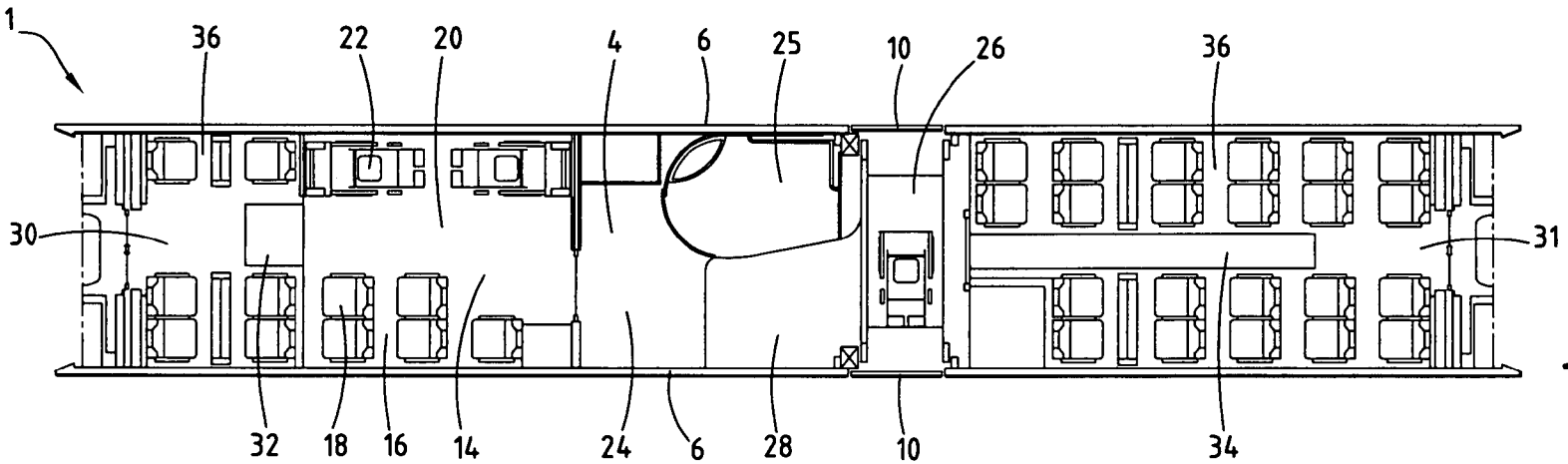
FIG. 2 is a top view, in diagrammatic form, of the railway vehicle of FIG. 1.

Referring to FIGS. 1 and 2, a railway vehicle carriage 1, such as a train wagon, comprising a body 2 formed by a floor 4, side walls 6 and a roof 8 is described. The body 2 comprises at least one door 10 allowing access to the inside of the railway vehicle 1. According to the embodiment shown, the door 10 is arranged substantially in the centre of each side wall of the body 2.

The carriage rests, in the conventional manner, on two bogies 12 provided at each end part of the body 2.

The floor 4 comprises at least one substantially flat intermediate platform 14. Intermediate is understood as meaning a platform whose floor height is conventional for a railway vehicle carriage. The floor height of the intermediate platform is, for example, substantially from 1000 mm to 1200 mm relative to the rails on which the carriage 1 is to travel.

In the embodiment shown in FIG. 2, the intermediate platform 14 comprises, along one lateral wall 6, a zone 16 having a plurality of seats 18 for accommodating passengers and, along the other lateral wall 6 opposite the zone 16, a zone 20 which does not have seats and is to accommodate wheelchairs 22 for passengers with reduced mobility. The standard platform further comprises a clear zone 24 which extends from one side wall to the other and forms a turning area for wheelchairs 22. The zone 24 facilitates the maneuvering of a wheelchair by providing a large space without obstacles. In the embodiment shown, a toilet cubicle 25 is arranged at the same height as the turning zone 24, facilitating access maneuvers to the toilet cubicle. The intermediate platform 14 is horizontal in order to facilitate the movement of passengers with reduced mobility between the zone 20 and the toilet cubicle 25.

The floor 4 further comprises at least one low platform 26 arranged opposite the door 10 of the railway vehicle 1. Low platform is understood as meaning that the floor height of said platform 26 is lower than the floor height of the intermediate platform 14. The low platform 26 is mounted to be movable in vertical translation so as to allow the floor height of the platform 26 to be varied. The floor height of the low platform 26 can vary, for example, substantially from 550 mm in the bottom low position to 950 mm in the nominal high position, which is the position assumed by the platform 26 when the carriage is moving. Accordingly, the height of the low platform 26 can be adapted to the height of the station platform at which the train stops, which allows passengers with reduced mobility to leave or enter the railway vehicle without the use of an external ramp. The amplitude of vertical mobility of the low platform 26 especially permits access to station platforms whose height can be variable from one station to another. Such station platforms can, for example, have a height substantially equal to 550 mm, 760 mm and 840 mm.

Movement of the low platform 26 is controlled by actuating means, which comprise, for example, at least one jack 126 arranged beneath the low platform 26. The actuating means are operated from the low platform or from the station platform, for example by means of a long-distance device 226 of the remote control type which is supplied to a passenger with reduced mobility in the station before he gets onto the train. Accordingly, the passenger with reduced mobility is able to actuate the movement of the low platform 26 himself and enter or leave the train without the intervention of the train or station staff.

When the carriage is moving, the low platform 26 is positioned in the nominal high position. The intermediate platform 14 and the low platform 26 are connected, in the nominal high position, by a ramp 28. The ramp 28 has a slope of substantially from 6% to 8%. The ramp 28 allows passengers to move from one platform to the other without a step between the different floor heights, which facilitates in particular the movement of a wheelchair. When the height of the low platform 26 is altered and the platform is at a height lower than that of the nominal high position, a step is created between the ramp 28 and the low platform 26.

In line with the bogies 12, the carriage 1 comprises two high floor levels 30 and 31 which are each arranged above a bogie 12 in order to permit passage above the bogies 12 to the end parts of the carriage 1. The height of the high floor levels 30 and 31 is substantially from 1200 mm to 1300 mm relative to the rails.

Ramps connect the high floor levels 30 and 31 to the adjacent horizontal platforms, these ramps serving as a corridor. Accordingly, one ramp 32 connects the intermediate platform 14 to the high floor level 30 and one ramp 34 connects the low platform 26, when it is in the nominal high position, to the high floor level 31.

Accordingly, it is possible to pass through the whole of the railway vehicle 1 without encountering a step, which allows passengers with reduced mobility to move unimpeded from one carriage to another.

The length of the ramps is defined in order to comply with the requirements laid down in standards in terms of ergonomics, which impose a maximum gradient as a function of the length of the ramp. To that end, the ramp 32 has a slope of substantially from 6% to 8% and the ramp 34 has a slope of substantially from 5% to 7% in the embodiment shown in the figures. Other slope arrangements are possible, provided that the railway accessibility standards, which specify maximum gradients as a function of the length of the slopes, are respected.

The space available between the walls 6 of the vehicle and the ramps 32 and 34 is preferably equipped with seats, as shown in FIG. 2. For aesthetic and ergonomic reasons (relative height in relation to the horizontal windows), the seats are arranged at a constant height; they therefore rest on platforms 36, which are at a beveled angle relative to the ramps 32 and 34 of the corridors. The height of the platforms 36 is substantially equal to the height of the high floor levels 30 and 31.

A functional space 38 for housing equipment of the railway vehicle extends beneath the floor 4 of the railway vehicle. The space in register with the platform 26 is reserved for the platform displacement mechanism. The carriage 1 accordingly allows space to be saved in the zones reserved for passengers by providing a large space beneath the floor 4, from one bogie to the other, for housing functional elements.

The carriage 1 described above allows passengers, and especially passengers with reduced mobility, to enter and leave without difficulty by adapting the height of the low platform 26, from which the vehicle is accessed, to that of the station platform and by allowing unimpeded movement between the railway vehicles 1 of the train. In addition, movement of the low platform 26 is preferably controlled by the passenger himself, without the intervention of the train or station staff. Moreover, access to the carriage from station platforms of low height, for example 550 mm, is also facilitated by adjusting the height of the low platform, while allowing functional equipment to be housed beneath the carriage.

The description has been given with reference to passengers who move about by means of a wheelchair. It will be understood, however, that the invention is also particularly advantageous for other wheeled items, such as pushchairs, trolleys, etc.

What is claimed is:

1. A railway vehicle carriage comprising:

two bogies provided at each end of the carriage;

a door of the railway carriage located between the two bogies; and a floor extending above and between the two bogies, the floor comprising:

at least one low platform located between the two bogies and arranged opposite the door, two high floor levels, each high floor level arranged above a corresponding bogie on either side of the low platform, and at least one intermediate platform arranged at an intermediate height between one of the high floor levels and the low platform, the low platform having a floor height lower than that of the high floor levels, the low platform being movable in vertical translation while being maintained horizontally so that a height of the low platform is adjustable in order to allow the height of the low platform to be adapted to a height of a railway vehicle station platform of variable height, the floor not having steps when the low platform is in a high position, the low platform being connected to one of the high floor levels by a ramp when the low platform is in the high position and the intermediate platform being connected to the low platform in the high position and to the other one of the high floor levels by other ramps.

2. The railway vehicle carriage according to claim 1, further comprising a functional space for housing equipment of the railway vehicle, said space being arranged substantially in register with and beneath at least part of the vehicle floor.

3. The railway vehicle carriage according to claim 2, wherein the functional space for housing equipment extends beneath substantially a whole of the length of the carriage.

4. The railway vehicle carriage according to claim 1 further comprising a plurality of seats arranged on first platforms so as to accommodate passengers; said first platforms having a height substantially equal to that of the high floor levels, the intermediate platform comprising a zone which does not have seats so as to accommodate passengers with reduced mobility.

5. The railway vehicle carriage according to claim 1 wherein a first ramp of the ramps extends between the at least one high floor level and the intermediate platform and has a slope of substantially from 6% to 8%.

6. The railway vehicle carriage according to claim 1 wherein a first ramp of the ramps extends between the at least one high floor level and the low platform and has a slope of substantially from 5% to 7%.

7. The railway vehicle carriage according to claim 1 wherein a first ramp of the ramps extends between the intermediate platform and the low platform and has a slope of substantially from 6% to 8%.

8. The railway vehicle carriage according to claim 1 wherein a floor height of the low platform is variable substantially from 550 mm to 950 mm relative to rails on which the railway vehicle is to travel.

9. The railway vehicle carriage according to claim 1 wherein a floor height of the intermediate platform is substantially from 1000 mm to 1200 mm relative to rails on which the railway vehicle is to travel.

10. The railway vehicle carriage according to claim 1 wherein a height of the high floor levels is substantially from 1200 mm to 1300 mm.

11. The railway vehicle carriage according to claim 1 wherein a difference in height between the floor and a ground clearance of the railway vehicle is substantially from 400 mm to 700 mm.

12. The railway vehicle according to claim 1 further comprising a remote control for the vertical translation of the low platform such as can be used by a passenger of the railway vehicle.

13. The railway vehicle according to claim 12 wherein the remote control includes a passenger remote control.

* * * * *